United States Patent [19]

Kashiwagi

[11] 4,293,765

[45] Oct. 6, 1981

[54] COUNTER

[75] Inventor: Tutomu Kashiwagi, Tokyo, Japan

[73] Assignee: Dai-Ichi Seiko Co., Ltd., Kawaguchi, Japan

[21] Appl. No.: 118,635

[22] Filed: Feb. 4, 1980

[30] Foreign Application Priority Data

Feb. 15, 1979 [JP] Japan ..... 54-16428
Oct. 4, 1979 [JP] Japan ..... 54-136693

[51] Int. Cl.[3] ..... G06C 15/42

[52] U.S. Cl. ..... 235/144 R; 235/1 C

[58] Field of Search ..... 235/1 C, 1 R, 133 R, 235/136, 139 R, 144 M, 144 DM, 144, DIG. 1, 144 R, 144 B, 144 C, 144 PN, 144 ME, 144 C, 144 HC, 144 D, 144 S, 144 SS, 144 SM, 144 SP, 144 TP, 144 ET, 144 MA, 144 EA, 144 E

[56] References Cited

U.S. PATENT DOCUMENTS 1,643,551 9/1927 Friden ..... 235/1 C
1,671,553 5/1928 Sheldrick ..... 235/1 C
2,384,220 9/1945 Vroom ..... 235/1 R
2,996,241 8/1961 Hoffmann ..... 235/1 C

*Primary Examiner*—L. T. Hix
*Assistant Examiner*—Benjamin R. Fuller
*Attorney, Agent, or Firm*—Cushman, Darby & Cushman

[57] ABSTRACT

A zero-restting type of counter comprising a plural number of digit wheels supported on the same shaft and having digit-shift pins, driven gears arranged between individual pairs of said digit wheels, intermittent transmission mechanisms for coupling the individual digit wheels with the corresponding driven gears, digit-shift pins and pinions engaged with said driven gears.

Said counter is adapted in such a manner that rotation of said driven gears caused by rotation of said pinions is transmitted by way of said intermittent transmission mechanisms to said digit wheels for the counting operation, whereas said intermittent transmission mechanisms do not transmit rotation and only said digit wheels are rotated when these wheels are rotated for resetting at the zero positions.

12 Claims, 21 Drawing Figures

COUNTER

BACKGROUND OF THE INVENTION (a) Field of the Invention

The present invention relates to a counter, and more specifically to a counter equipped with a novel zero-resetting device.

(b) Description of the Prior Art

Most of the conventional counters have such a construction as shown in FIG. 1 and FIG. 2. In these figures, the reference numeral 1 represents a frame, and the reference numerals 3, 4 and 5 designate digit wheels which are equipped with heart-shaped cams 3*a*, 4*a* and 5*a*, driven gears 3*b*, 4*b* and 5*b* and further digit-shift pins 3*c*, 4*c* and 5*c* having two teeth. Said digit wheels are supported on a support shaft 2. The reference numeral 6 denotes a pinion mount rotatably mounted by a support shaft 6*a* on the frame 1 and having reset finger 7 on which a compressing portion is formed to compress said heart-shaped cams. The reference numeral 8 represents a support shaft attached to the pinion mount 6, the reference numerals 9, 10 and 11 designate pinions supported respectively on the shaft 8 and having teeth 9*a*, 9*b*; 10*a*, 10*b*; and 11*a*, 11*b* on the right and left sides respectively as illustrated. On the right sides of the pinions 10 and 11 among these pinions, the teeth 10*b* and 11*b* are alternately longer (i.e., longitudinally thicker). The reference numeral 12 denotes an auxiliary gear which is rotatably supported on the support shaft 2, engaged with the pinion 9 and has a worm gear 12*a*. The reference numeral 13 represents a rotational drive shaft which is supported on the frame 1, and equipped at one end thereof with a worm 13*a* engaged with the worm gear 12*a* and at the other end thereof with a pulley 13*b*. The reference numeral 14 designates a resetting lever. In a counter having such a construction as described above, the pinion mount 6 is always pressed by a spring 15 in the direction opposite to that indicated by an arrow B in FIG. 1, the pinion 9 is engaged with the auxiliary gear 12 and driven gear 3*b*, the pinion 10 is engaged with the driven gear 4*b*, the pinion 11 is engaged with the driven gear 5*b* respectively, and the reset finger 7 is located apart from the heart cams 3*a*, 4*a* and 5*a*. Therefore, when the pulley 13*b* is rotated with a belt (not shown) passing around said pulley, the rotational drive shaft 13 is rotated, and its rotation is transmitted to the worm 13*a*, worm gear 12*a*, auxiliary gear 12, pinion 9 and driven gear 3*b*, whereby the digit wheel of the units stage is rotated and then the other digit wheels 4 and 5 are rotated in the known sequence to count number of rotations of the rotational drive shaft 13. In order to reset the counter at zero at the subsequent step, the resetting lever 14 is pushed in the direction indicated by the arrow A in FIG. 1. Since this pushing of the resetting lever 14 causes the pinion mount 6 to be rotated around the support shaft 6*a* in the direction indicated by the arrow B in FIG. 1, the pinions 9, 10 and 11 are disengaged from the auxiliary gear 12, driven gears 3*b*, 4*b* and 5*b* respectively, and the compressing portion of the reset finger 7 compresses simultaneously the heart cams 3*a*, 4*a* and 5*a* which are formed integrally with the digit wheels regardless of positions thereof, whereby said digit wheels are reset at the zero positions. In resetting such a conventional counter at zero, the resetting lever is pushed to rotate the pinion mount 6, which in turn shifts the pinion shaft 8 attached thereto together with the pinions 9, 10 and 11 to disengage these pinions from the driven gears 3*b*, 4*b* and 5*b* arranged on the digit wheels 3, 4 and 5, whereafter the heart cams 3*a*, 4*a* and 5*a* are compressed by the compressing portion formed on the reset finger 7 of the pinion mount. In order to disengage the pinions 9, 10 and 11 from the driven gears 3*b*, 4*b* and 5*b* formed on the digit wheels 3, 4 and 5, it is required to shift each of the pinions, thereby making it necessary to reserve space for this purpose which constitutes hindrance in designing a compact counter. In addition, the conventional counter has another defect to require a large number of component members including, for example, a restricting spring 16 on the pinion mount in order to prevent the pinions from being rotated in disengaging the pinions from the driven gears.

SUMMARY OF THE INVENTION

The object of the present invention is to provide a compact counter consisting of a small number of component members and having simple construction which is designed in such a manner that each of the driven gears for the digit wheels are separated from said digit wheels and intermittent transmission mechanisms are arranged between said gears and wheels so that the gears and wheels are rotated integrally for counting operation but only the digit wheels are rotated to the zero positions in resetting the counter at zero, thereby eliminating the necessity to disengage the pinions from the driven gears and digit-shift pins and to arrange a restricting spring for preventing the pinions from being rotated in resetting said counter at zero.

BRIEF DESCRIPTIONS OF THE DRAWINGS

DESCRIPTION OF THE PREFERRED EMBODIMENTS

Figure 1:
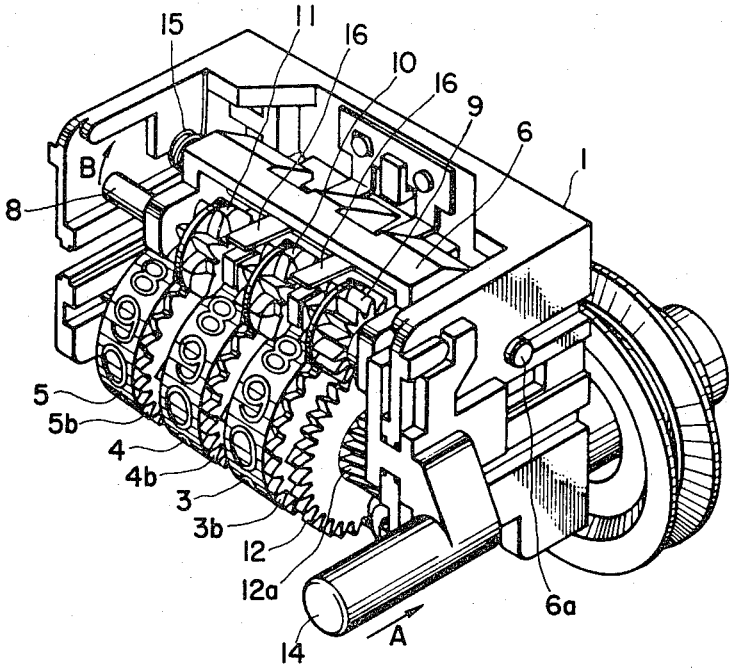
FIG. 1 PRIOR ART
FIG. 1 shows a perspective view illustrating the construction of the conventional counter.
Figure 2:
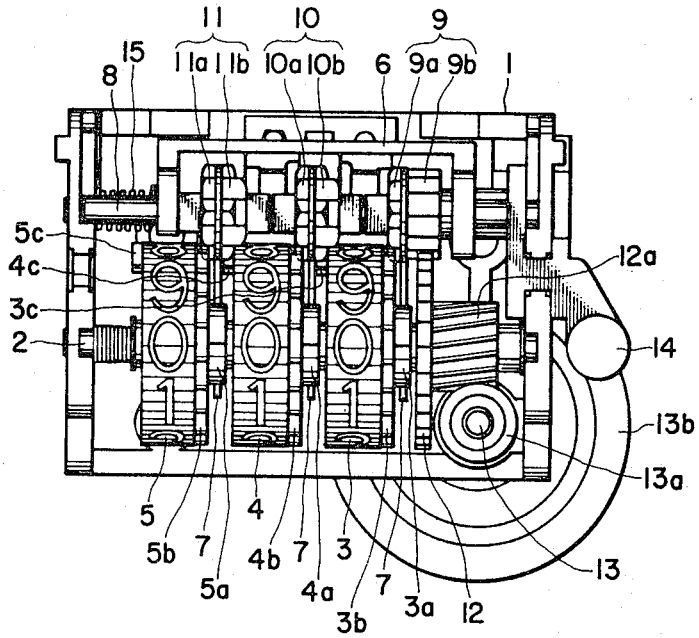
FIG. 2 PRIOR ART
FIG. 2 shows a front elevational view of the conventional counter.
Figure 3:
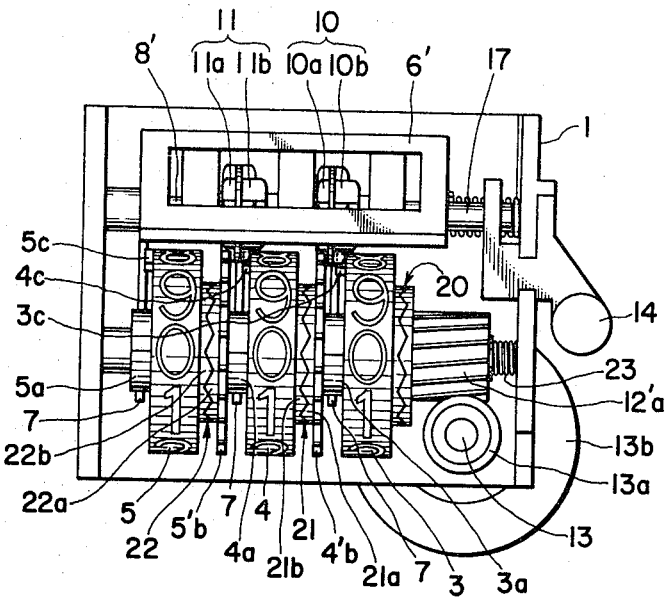
FIG. 3 shows a front elevational view illustrating the construction of the counter according to the present invention as a first embodiment thereof.

Now, the present invention will be described more detailedly with reference to the accompanying drawings. A first embodiment of the present invention is shown in FIG. 3 in which the component members having substantially the same functions as those of the conventional counter are represented with the same reference numerals used in FIG. 1 and FIG. 2., and will not described particularly. In FIG. 3, the reference numerals 10 and 11 represent pinions which are supported together with a pinion mount 6' on a support shaft 8' attached to the frame 1 and always engaged with driven gears to be described later and digit-shift pins 3c and 4c. The reference numerals 4'b and 5'b designate driven gears which are supported on the support shaft 2 and coupled with digit wheels 4' and 5' by way of the intermittent transmission mechanisms 21 and 22 respectively. These intermittent transmission mechanisms are composed, for example, of two pairs of members 21a, 21b and 22a, 22b having shallow corrugations engaged with each other, members 21a and 22a being integrally coupled with the driven gears 4'b and 5'b respectively, whereas members 21b and 22b being integrally coupled with the digit wheels 4' and 5' respectively. Therefore, rotation of one pair of the members causes rotation of the other pair of the members so long as the driven gears and digit wheels are in freely rotable condition. When one pair of the members are restricted under a force, only the other pair of the members are rotatable. That is to say, when rotation of the pinions 10 and 11 causes the driven gear 4'b or 5'b to rotate for counting operation, the digit wheels 4 and 5 are rotated through the intermittent transmission mechanisms 21 and 22 respectively. In resetting the counter at zero, however, rotation of the digit wheels does not cause rotation of the driven gears since they are engaged with the pinions (the pinions are so arranged as to make the longer ones of the teeth 10b and 11b ride over the outer circumference of the digit wheels in the same manner as that in the conventional example shown in FIG. 2 and can rotate only for advancing digit). Therefore, if a force exceeding the required level is applied to the digit wheels in resetting the counter at zero, the coupling through said intermittent transmission mechanisms is released and only the digit wheels are rotated while sliding on the driven gears. The reference numeral 12'a represents a worm gear which is supported on the support shaft 2 and coupled with the digit wheel 3 by way of an intermittent transmission mechanism 20 having the same construction as that of the intermittent transmission mechanisms described above, said worm gear having the function similar to those of the gear 4'b and 5'b. The reference numeral 23 designates a retaining spring which functions to compress the worm gear 12'a mounted on the support shaft 2, digit wheels 3, 4 and 5, and driven gears 4'b and 5'b in the leftward direction in FIG. 3. Under the force of this spring, the worm gear 12'a, driven gears 4'b and 5'b are coupled under pressure with the digit wheels 3, 4 and 5 respectively. The counter having such a construction as described above can display a number corresponding to number of its rotation on the digit wheels 3, 4 and 5 in the same manner as that on the conventional counter utilizing the rotation by way of a belt and a pulley 13b, and permits resetting at zero by pushing the lever 14. That is to say, when the reset pin 17 is pushed with the tip of the reset lever 14 by pushing the lever 14, the pinion mount 6' is rotated around the support shaft 8' in the clockwise direction as seen from the right in FIG. 3, whereby the compressing portion of the reset finger 7 pushes the heart cams 3a, 4a and 5a simultaneously to rotate the digit wheels 3, 4 and 5 regardless of positions of said digit wheels. If the rotating force is higher than the required level, the coupling through the intermittent transmission mechanisms is released and the digit wheels 3, 4 and 5 are rotated to return to the zero positions while sliding on the driven gears 4'b and 5'b. In this counter, the pinions 10 and 11 are still engaged with the driven gears 4'b and 5'b respectively even in resetting at zero. For this reason, it is unnecessary to arrange a restricting spring or an equivalent member for preventing rotation of the pinions 10 and 11.

In the counter according to the present invention, the intermittent transmission mechanism may have any construction so far as it permits rotating integrally both the digit wheels and gears which are coupled with each other by said mechanism for the counting operation, and allows only the digit wheels to rotate in resetting the counter at zero.

Now, descriptions will be given to other embodiments in which only the intermittent transmission mechanism is different with the other component members being the same as those adopted in the above-described embodiment 1. Therefore, only the intermittent transmission mechanism will be described and shown in the drawings for the subsequent embodiments of the present invention.

Figure 4:
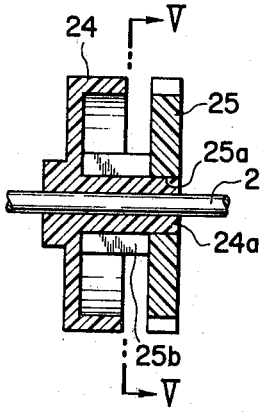
FIG. 4 illustrates a sectional view showing construction of the intermittent transmission mechanism for a second embodiment of the present invention.
Figure 5:
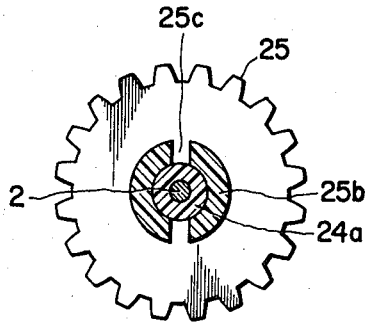
FIG. 5 illustrates a sectional view taken along the V—V line in FIG. 4.

Shown in FIG. 4 and FIG. 5 is a second embodiment in which a shaft 24a of the digit wheel 24 is extended so as to protrude outside said digit wheel, whereas a run-through slot 25a is formed in the driven gear 25 for fitting the shaft 24a, a protrusion 25b is formed on the digit wheel side surface of the driven gear 25, and a groove 25c is formed in said protrusion 25b to give it a spring property. The shaft 24a of the digit wheel 24 is inserted and fitted in the run-through slot 25a of the gear 25 as shown in the drawings. When this intermittent transmission mechanism is combined with the digit wheels 3, 4 and 5, worm gear 12a, driven gears 4'b and 5'b of the counter illustrated in FIG. 3, said intermittent-transmission mechanism performs the same functions as that in the embodiment 1 shown in FIG. 3. When the driven gear 25 is rotated by rotation of the pinion, for example, the digit wheel 24 is rotated since it is attached loosely to the shaft 2, its shaft 24a is fitted into the run-through slot 25a of the driven gear 25 and the protrusion of the driven gear has a spring property. When the heart cams are forcibly pushed by depressing the reset lever at the next stage, only the digit wheel 24 is rotated since the driven gear 25 is engaged with the pinion and is immovable.

Figure 6:
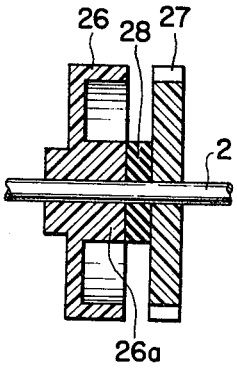
FIG. 6 illustrates a sectional view showing construction of the intermittent transmission mechanism for a third embodiment of the present invention.

FIG. 6 illustrates a third embodiment of the present invention in which a ring-like member 28 having a large coefficient of friction is fixed to a shaft 26*a* of the digit wheel 26 by a means such as bonding. When the digit wheel 26 and driven gear 27 which are coupled with each other through this intermittent transmission mechanism are used in the counter shown in FIG. 3., rotation of the driven gear 27 is frictionally transmitted to the ring-like member 28 arranged adjacent thereto and the digit wheel fixed integrally with said ring-like member 28 is also rotated. When the digit wheel 26 is rotated forcibly by depressing the reset lever for resetting the counter at zero, on the other hand, the driven gear 27 does not rotate though the ring-like member 28 is rotated integrally while sliding.

It is possible to fix the ring-like member 28 to the driven gear 27 and allow frictional transmission between the digit wheel and said ring-like member. It is further possible to fix ring-like members to the digit wheel 26 and gear 27 respectively, and allow frictional transmission between said ring-like members.

Figure 7:
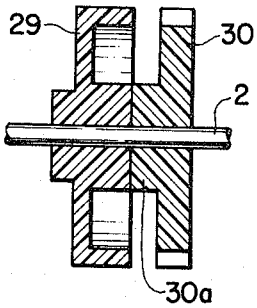
FIG. 7 illustrates a sectional view showing construction of the intermittent transmission mechanism for a fourth embodiment of the present invention.

Illustrated in FIG. 7 is a fourth embodiment of the present invention in which the gear 30 is entirely made of a material having a large coefficient of friction. It is possible to make the digit wheel 29 only or both of the digit wheel 29 and driven gear 30 of a material having a large coefficient of friction.

Figure 8:
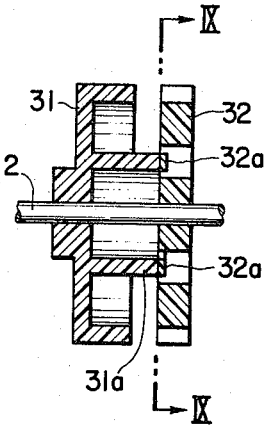
FIG. 8 shows a sectional view illustrating construction of the intermittent transmission mechanism for a fifth embodiment of the present invention.
Figure 9:
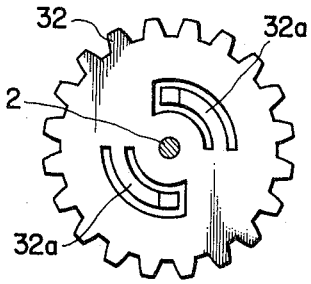
FIG. 9 shows a sectional view taken along the IX—IX line in FIG. 8.

FIG. 8 and FIG. 9 show a fifth embodiment of the present invention in which a circular protrusion 31*a* is formed on the digit wheel 31 and a resin spring 32*a* is formed on the driven gear 32, said protrusion 31*a* and resin spring 32*a* being coupled with each other as illustrated. In this construction, the surface of the circular protrusion 31*a* on the digit wheel 31 are compressed under pressure to the resin spring 32*a* of the gear 32 so that rotation of the gear is transmitted directly to the digit wheel, whereas rotation of the digit wheel is not transmitted to the gear since the former slides.

Figure 10:
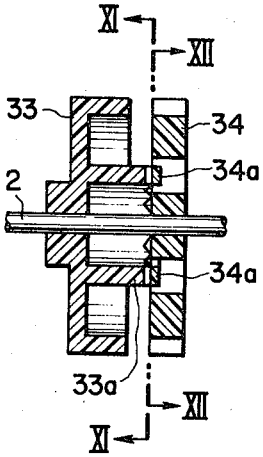
FIG. 10 shows a sectional view illustrating constraction of the intermittent transmission mechanism for a sixth embodiment of the present invention.
Figure 11:
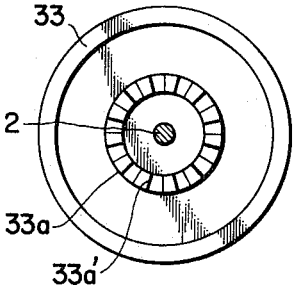
FIG. 11 shows a sectional view taken along the XI—XI line in FIG. 10.
Figure 12:
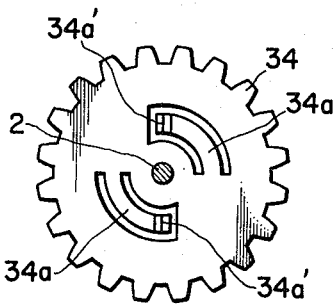
FIG. 12 shows a sectional view taken along the XII—XII line in FIG. 10.

FIG. 10 through FIG. 12 show a sixth embodiment of the present invention in which teeth 33*a*′ are formed on the end surface of the circular protrusion 33*a* which in turn is formed on the digit wheel 33 and another protrusion 34*a*′ is formed on the tip of the resin spring 34*a* which in turn is formed on the driven gear 34. In this construction, rotation of the gear can be transmitted to the digit wheel by engaging and compressing under pressure the protrusion on the tip of the resin spring with and onto the teeth on the end surface of the circular protrusion utilizing elasticity of said resin spring, and only the digit wheel can be rotated when it is rotated forcibly for resetting it at zero.

Figure 13:
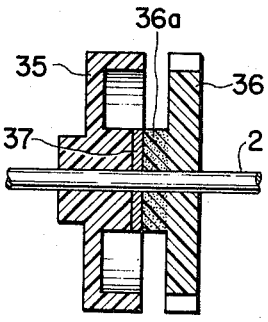
FIG. 13 shows a sectional view of the intermittent transmission mechanism for a seventh embodiment of the present invention.

Illustrated in FIG. 13 is a seventh embodiment of the present invention in which a metal piece 37 is fixed to the digit wheel 35 by a means such as bonding and a magnet 36*b* is fixed to the driven gear 36. Since the metal piece 37 is attracted to the magnet, the digit wheel 35 is rotated integrally with the gear 36 when the latter is rotated, but only the digit wheel 35 rotates when it is rotated forcibly.

Figure 14:
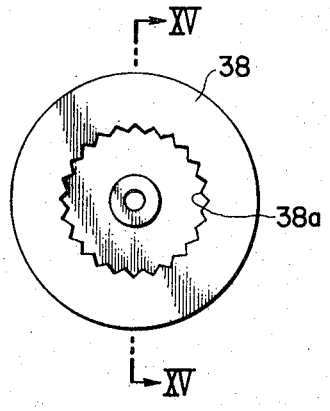
FIG. 14 shows a plan view illustrating a digit wheel for an eighth embodiment of the present invention.
Figure 15:
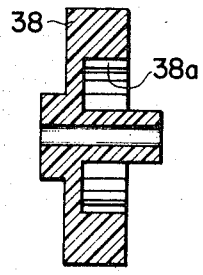
FIG. 15 shows a sectional view taken along the XV—XV line in FIG. 14.
Figure 16:
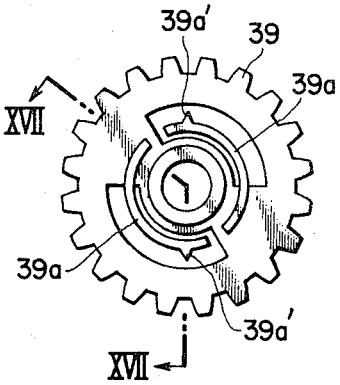
FIG. 16 shows a plan view illustrating a driven gear for the eighth embodiment.
Figure 17:
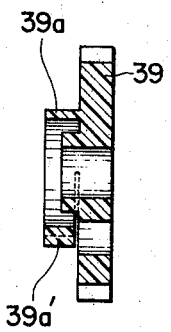
FIG. 17 illustrates a sectional view taken along the XVII—XVII line in FIG. 16.
Figure 18:
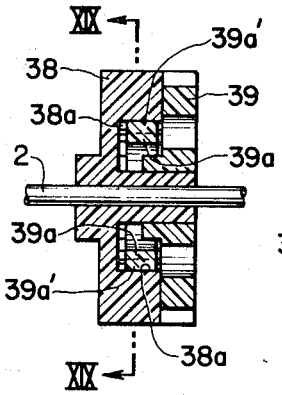
FIG. 18 illustrates a sectional view showing construction of the intermittent transmission mechanism for the eighth embodiment.
Figure 19:
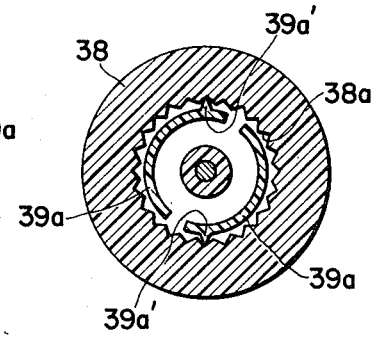
FIG. 19 illustrates a sectional view taken along the XIX—XIX line in FIG. 18.

In this embodiment, it is possible to use as the magnet 36*a* a synthetic resin magnet which is prepared by mixing a synthetic resin material with magnetic power and magnetizing the powder, or a rubber magnet. It is further possible to arrange a magnet on the digit wheel 35 and a metal piece on the driven gear 36. Moreover, the whole body of the driven gear can be designed as a magnet. FIG. 14 through FIG. 19 illustrate an eighth embodiment of the present invention in which teeth 38*a* are formed on the inside surface of the digit wheel 38 as shown in FIG. 14 and FIG. 15, an arc-like resin spring 38*a* equipped on its tip with a protrusion 39*a*′ is formed on the driven gear 39 as shown in FIG. 16 and FIG. 17, and the digit wheel 38 is combined with the driven gear 39 as shown in FIG. 18. In this construction, the protrusion 39*a*′ of the resin spring 39*a* arranged on the driven gear 39 is engaged and compressed with and onto the teeth 38*a* formed on the digit wheel 38. Therefore, rotation of the driven gear 39 causes the digit wheel 38 to be rotated therewith, whereas rotation of said digit wheel is not transmitted to the driven gear 39.

Figure 20:
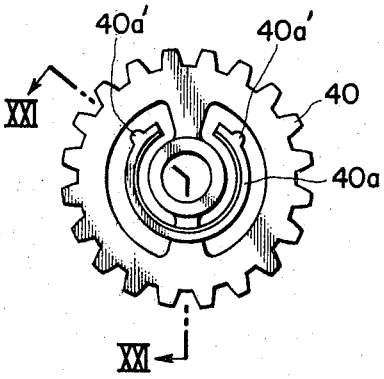
FIG. 20 illustrates a plan view showing a driven gear for a ninth embodiment of the present invention.
Figure 21:
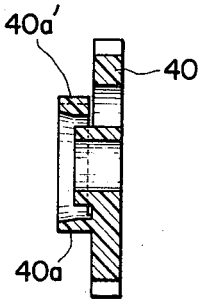
FIG. 21 illustrates a sectional view taken along the XXI—XXI line in FIG. 20.

Shown in FIG. 20 and FIG. 21 is a ninth embodiment of the present invention which corresponds to an improved version of the eighth embodiment and uses a nearly semispherical protrusion on the tip of the resin spring arranged on the driven gear 39 adopted in the eighth embodiment. Speaking concretely, a semispherical protrusion 40*a*′ is arranged on the tip of the resin spring 40*a* formed on the driven gear 40. This driven gear 40 is used in combination with the digit wheel which has the same shape as the digit wheel 38 used in the eighth embodiment in the same manner as that illustrated in FIG. 18 and FIG. 19. By designing the protrusion 40*a*′ in the semispherical shape, the digit wheel can rotate smooth in both directions relative to the driven gear.

As is understood from the foregoing descriptions, the counter according to the present invention can eliminate the necessity to disengage individual pinions from the driven gears and digit-shift pins, thereby making it unnecessary to reserve the space for the disengaging and making it possible to realize a compact counter. In addition, the individual pinions can be kept engaged with the corresponding driven gears and digit-shift pins even in resetting said counter at zero, thereby making it unnecessary to use a restricting spring for preventing rotation of said pinions and making it possible to reduce number of required component members, etc. Moreover, the present invention permits utilizing the support shaft of the pinion mount also as the support shaft for the pinions, making it possible to simplify construction of the counter and further reducing number of component members thereof.

I claim:

1. A counter comprising a worm wheel and a plural number of digit wheels which are supported on a shaft attached to a frame, driven gears supported on said shaft and arranged between individual pairs of said digit wheels, intermittent mechanisms arranged between said worm wheels and the lowermost digit wheel adjacent thereto and between each digit wheel and the next lower digit wheel and pinions which are supported on another shaft attached to said frame and so positioned as to engage with two teeth formed on each digit wheel and each driven gear at the same time, said counter being so adapted in such a manner that when each of said intermittent transmission mechanisms and each of said driven gears are rotated, their rotation is transmitted to said digit wheels to rotate them integrally with said members, whereas when the digit wheels are rotated for resetting them at the zero positiond, said driven gear are made immovable by said pinions and only said digit wheels are rotated.

2. A counter according to claim 1 wherein each of said intermittent transmission mechanisms is composed of two components parts having corrugated teeth engaged with each other, one of said component part being coupled with one of said digit wheels and another component part being coupled with one of said gears.

3. A counter according to claim 1 wherein each of said intermittent transmission mechanism is composed of a shaft formed integrally with one of said digit wheels and a protrusion formed integrally with one of said driven gear having a runthrough slot for fitting said shaft and spring properly.

4. A counter according to claim 1 wherein each of said intermittent transmission mechanisms is composed by making at least the contact surface of at least either of said digit wheels and said gears of a material having a large coefficient of friction.

5. A counter according to claim 4 wherein ring-like members made of a material having a large coefficient of friction are fixed to at least either of said digit wheels and said gears.

6. A counter according to claim 4 wherein at least either of said digit wheels and said gears are made of a material having a large coefficient of friction.

7. A counter according to claim 1 wherein said intermittent transmission mechanisms consist of circular protrusion fixed to said digit wheels and spring-like members attached to said gears and being in contact at least on the tips thereof with the end surfaces of said circular protrusions.

8. A counter according to claim 7 wherein teeth are formed at the end surfaces of said circular protrusions and the tips of said spring-like members have convexties fitted into the valleys between the teeth formed on said circular protrusions.

9. A counter according to claim 1 wherein said intermittent transmission mechanisms consist of a magnetic material fixed to either of said digit wheels and said gears, and a magnet fixed to the other of said digit wheels and said gears.

10. A counter according to claim 9 wherein said magnet is made of a synthetic resin.

11. A counter according to claim 1 wherein said intermittent transmission mechanisms consist of teeth formed on the inside surfaces of said digit wheels and arc-like springs formed on said gears and having protrusions engaged with said teeth.

12. A counter according to claim 11 wherein the protrusions formed on the tips of said arc-shaped springs have a semispherical form.

* * * * *